United States Patent [19]

Hall

[11] 4,013,026

[45] Mar. 22, 1977

[54] SEWING MACHINE FEEDER SYSTEM

[76] Inventor: W. Richard Hall, 4261 Smithsonia Drive, Tucker, Ga. 30084

[22] Filed: July 7, 1975

[21] Appl. No.: 593,700

[52] U.S. Cl. ..... 112/153; 112/205

[51] Int. Cl.[2] ..... D05B 35/10

[58] Field of Search ..... 112/153, 148, 151, 136, 112/121.15, 121.24, 205, 204

[56] References Cited

UNITED STATES PATENTS

| | | | |
|---|---|---|---|
| 3,815,530 | 6/1974 | Denton | 112/150 X |
| 3,905,316 | 9/1975 | Mall | 112/153 |
| 3,924,551 | 12/1975 | Heiler et al. | 112/153 |

*Primary Examiner*—H. Hampton Hunter
*Attorney, Agent, or Firm*—Jones, Thomas & Askew

[57] ABSTRACT

A sewing machine feeder system includes a fluid powered clamp assembly which applies tension to the plies of material being pulled into the needle of a sewing machine by the feed dogs, with more tension being applied to the lower ply of material. The effective point of application of the tension to the plies of material is offset to the left from the line of pull of the feed dogs which causes the plies of material to tend to turn in a counterclockwise direction into a vertical guide, and the plies of material are maintained in a flat and unwrinkled configuration against the vertical guide so that the plies of material hold themselves properly aligned from the guide to the needle of the sewing machine.

6 Claims, 4 Drawing Figures

60
64
61
62
20
75
68
117
119
18
112
72
108
114
113
74
115
19
110
109
111
62
118
64
116
61
59
101
102
71
105
98
100
92
94
99
104
95
96
69
88
86
79
85
89
81
80
78
70
90
76
84
91
82

SEWING MACHINE FEEDER SYSTEM

BACKGROUND OF THE INVENTION

When a sewing machine operator guides two plies of material through the reciprocating needle of a sewing machine during the sewing function, the feed dogs of the sewing machine oscillate continually to engage and pull the lower ply of material through the needle while the pressure foot of the machine urges the upper ply of material down toward the feed dogs. The presser foot applies drag to the top ply of material while the feed dogs positively urge the lower ply of material through the sewing machine, and this results in the lower ply of material being moved through the sewing machine at a slightly faster rate than the upper ply of material. When two long pieces of material of equal length are matched together so that their leading and trailing ends are in alignment and pieces are sewn together, the difference in movement between the lower ply and the upper ply of material during the sewing process usually causes the trailing ends of the plies of material to be mismatched at the completion of the sewing operation.

Sewing machine operators that are accustomed to sewing long lengths of material usually hold the plies of material between their fingers, with the upper ply of material being held between the index and middle fingers and the lower ply of material being held between the middle and ring fingers. The fingers of the operator not only guide the layers of material to the machine but also apply a small amount of tension to the portions of the layers of material extending from the fingers of the operator's hand to the feed dogs and presser foot of the sewing machine. The ring and middle fingers usually apply more drag friction to the lower ply of material so that the increased tension in the lower ply of material restrains and stretches the lower ply slightly more than the upper ply, which compensates for the drag friction applied to the upper ply of material by the presser foot of the sewing machine. With this technique, an experienced sewing machine operator frequently is able to match the trailing ends of long pattern parts at the end of a long sewing run.

When a long sewing run is required, as when an inseam or a side seam of trousers is being sewn, the sewing machine and its operator usually must sew over multiple layers of materials that may occur at seams or pockets, etc. The fingers of the sewing machine operator must accommodate the additional plies of material as they are processed toward the sewing machine, and any curves in the matched pattern parts require the operator to turn the plies of material as the plies of material are being fed to the machine. Thus, the procedure to form a commercially acceptable seam in a long length of matched plies of material is sometimes complicated and requires the skill of an experienced and an adept machine operator.

SUMMARY OF THE INVENTION

Briefly described, the present invention comprises a sewing machine feeder system, including both a process and apparatus, for guiding matched plies of material or pattern parts to a sewing machine or similar material connector apparatus. The upper and lower plies of material move on opposite sides of a horizontal guide plate positioned at the entrance of a sewing machine, and upper and lower clamp plates are moved by fluid pressure toward the guide plate and exert frictional drag on both plies of material as the plies of material are pulled into the sewing machine. The lower clamp plate is urged with more force toward the guide plate to exert more drag friction on the lower ply of material, causing more tension to occur in the portion of the lower ply of material extending between the clamp plate and the feed dogs and presser foot of the sewing machine. The effective points of contact of the drag applied to the upper and lower plies of material are offset laterally to the left side of the path of the feed dogs, which causes the plies of material to tend to turn in a counterclockwise direction as they are pulled into the needle. The clamp plates together with the guide plate maintain the plies of material in a flat configuration, and vertical guides keep the edges of material from turning out of alignment with the proper path of travel of the material through the needle. The arrangement causes the plies of material to be urged to their properly aligned position as the plies move into the sewing machine even when curved edges of material are being sewn.

The clamp plates are fluid powered with a valve system controlled by the machine operator so that the operator can open the clamp plates to initially insert the material about the guide plate, and the operator can partially relieve the fluid pressure from the system to accommodate additional thicknesses of material, such as pockets or seams, as these additional plies of material move through the guide system to the needle of the sewing machine.

Thus, it is an object of the present invention to provide a sewing machine feeder system for automatically and accurately feeding multiple plies of material in overlying relationship to a sewing machine without allowing the bottom ply of material to be fed at a faster rate than the top ply.

Another object of the present invention is to provide a sewing machine feeder system which automatically and accurately guides both straight and curved matched pattern parts to a sewing machine or the like.

Another object of the present invention is to provide a sewing machine feeder system which is inexpensive to construct, accurate in operation, and which does not require an experienced, highly skilled operator.

Other objects, features and advantages of the present invention will become apparent upon reading the following specification, when taken in conjunction with the accompanying drawing.

DETAILED DESCRIPTION

Figure 1:
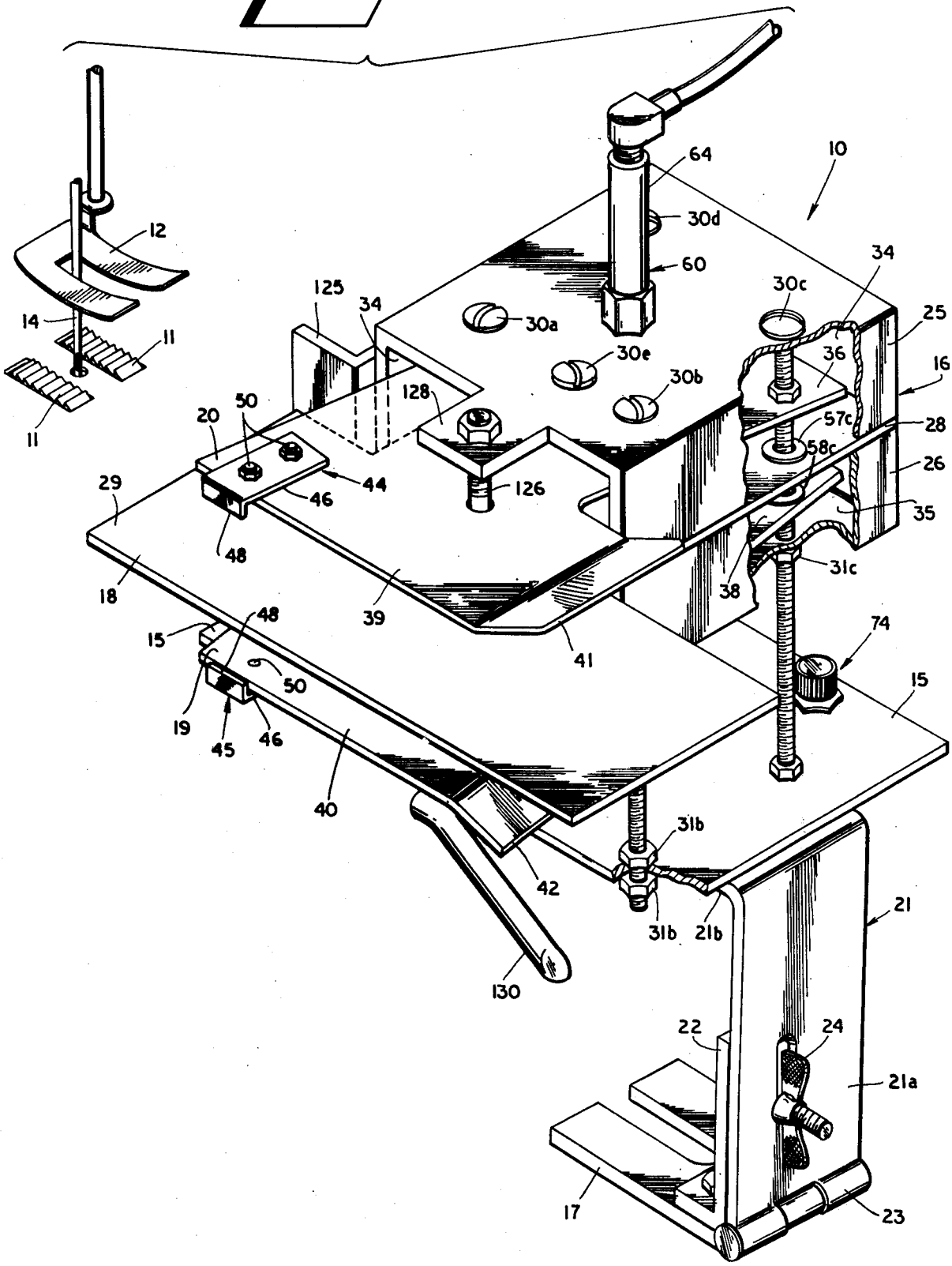
FIG. 1 is a schematic perspective illustration of the sewing machine feeder system, with parts broken away.

Referring now in more detail to the drawing, in which like numerals indicate like parts throughout the several views, FIG. 1 illustrates the sewing machine feeder system which includes a guide means 10 positioned at the entrance of a sewing machine just ahead of the feed dogs 11, presser foot 12, and reciprocatable sewing needle 14. Guide means 10 includes a support platform 15, housing 16, horizontal guide plate 18, and lower and upper clamp plates 19 and 20. Support platform 15 can be mounted from any conventional surface adjacent the entrance to a sewing machine, usually from the work table which extends about the sewing machine. The embodiment illustrated herein includes a mounting bracket 17 and L-shaped stanchion 21. The vertical leg 21*a* of the stanchion 21 is hingedly connected at its lower edge by hinge 23 to the mounting bracket 17, while the horizontal leg 21*b* is attached to the bottom surface of support platform 15. An upright brace 22 is rigidly connected to the mounting bracket 17, and wing nut and screw 24 releasibly connect together the upright leg and the brace 22 in the manner illustrated. When the wing nut and screw 24 are unthreaded, the stanchion 21 can be pivoted about is lower hinge 23 to move the support platform and its connected elements through an arc away from the sewing machine, so that maintenance personnel can have easy access to the sewing machine. Support platform 15 is illustrated as being in a horizontal attitude, and housing 16 is mounted on support platform 15; however, these elements can be tilted as desired to enhance the operation of the guide means.

Housing 16 comprises upper and lower U-shaped housing elements 25 and 26, with the open portion of the upper U-shaped housing element faced in a downward direction and the open portion of the lower U-shaped housing element 26 faced in an upward direction. Guide plate 18 is approximately T-shaped, and the narrow base leg 28 of guide plate 18 extends between the upper and lower U-shaped housing elements 25 and 26. The enlarged exterior leg 29 of the T-shaped guide plate 18 extends beyond the confines of the housing elements 25 and 26 and is located at the entrance of the sewing machine, in alignment with the feed dogs, presser foot and reciprocatable needle of the sewing machine. Five vertical mounting screws 30*a*, 30*b*, 30*c*, 30*d* and 30*e* extend through the upper and lower housing elements and through the base leg 28 of the T-shaped guide plate 18 and downwardly through the support platform 15. Nuts or other holding elements are threaded on the vertical mounting screws to retain the elements supported by the mounting screws in their proper locations. For example, a pair of nuts 31*b* are threaded on vertical mounting screw 30*b* on opposite sides of support platform 15 to hold the housing 16 over the support platform, and a nut 31*c* is threaded on vertical mounting screw 30*c* to hold the upper and lower U-shaped housing elements in their sandwiched relationship about the guide plate 29.

Upper housing element 25 and the base leg 28 of the guide plate 18 defines an upper housing enclosure 34, while lower housing element 26 and the base leg 28 of the guide plate 18 define a lower housing enclosure 35. Clamp plates 19 and 20 are approximately similar in configuration in that each includes a base leg 36 and 38 and a clamping leg 39 and 40. The base legs 36 and 38 of the clamp plates are of a width approximately equal to the inside dimensions of the upper and lower housing enclosures 34 and 35, while their clamping legs 39 and 40 are wider. The edges 41 and 42 of the clamping legs 39 and 40 which face away from the sewing machine are curved vertically away from guide plate 18, with the edge 41 of upper clamp plate 20 turned upwardly and the edge 42 of lower clamp plate 19 turned downwardly. Bracket 44 is mounted on upper clamp plate 20 while bracket 45 is mounted on lower clamp plate 19. Brackets 44 and 45 are identical in construction and each includes a mounting leg 46, an angled protrusion 48. Mounting holes (not shown) are formed in the clamp plates 19 and 20 and in the mounting legs 46 of the of the brackets, and recessed head bolts 50 extend through the mounting holes of the clamp plates and brackets to rigidly connect the brackets to the clamp plates. The angle protrusion 48 of each bracket extends about the outside edge of each clamp plate 19 and 20 toward guide plate 18. The length of the clamp plate extending beyond housing 16 is shorter than the length of the guide plate 18, so that angle protrusions 48 of the brackets 44 and 45 extend toward the upper and lower surfaces of the guide plate 18.

Figure 2:
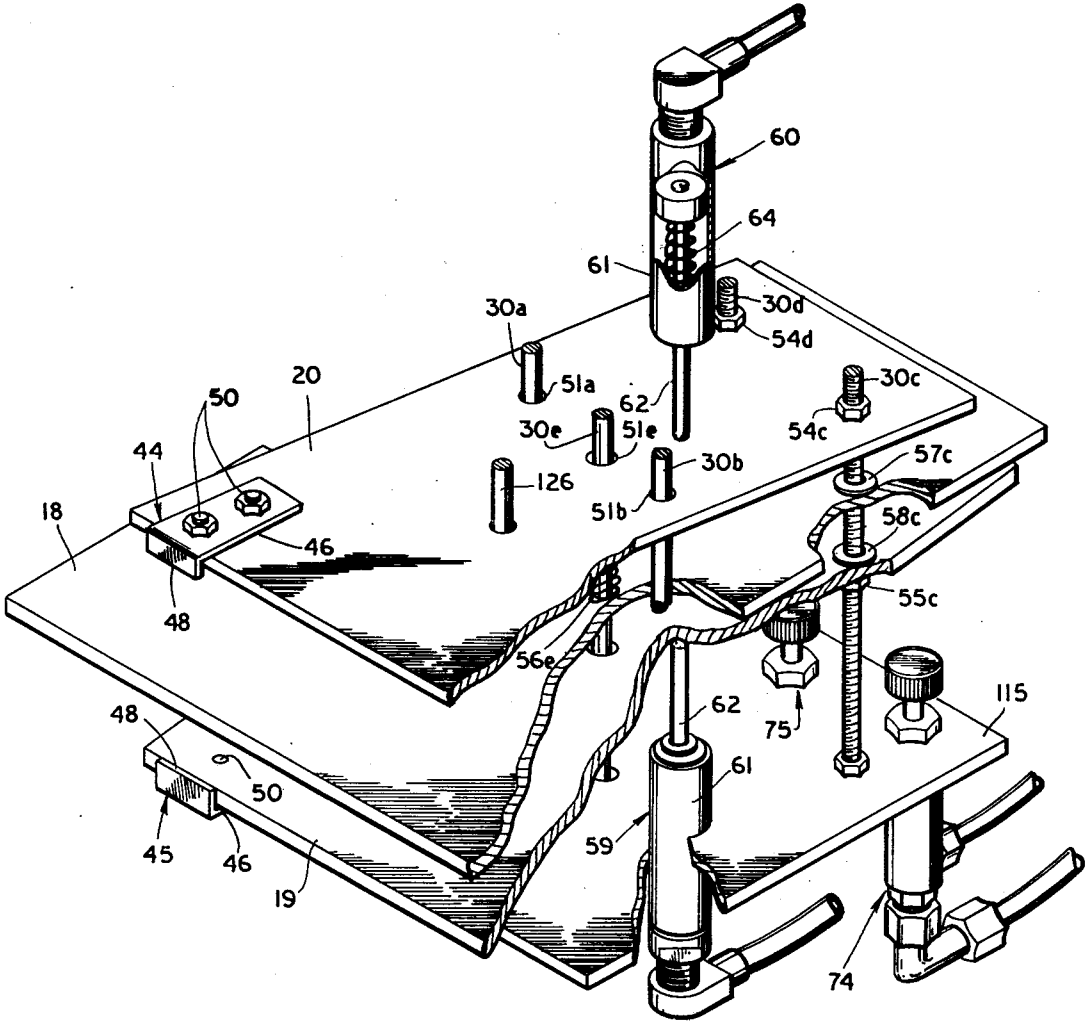
FIG. 2 is a schematic perspective illustration of the sewing machine feeder, similar to FIG. 1, but with the housing and other components removed to illustrate the inside components of the assembly.

The base legs 36 and 38 of the upper and lower clamp plates 20 and 19 define five oversized alignment holes inserted about the vertical mounting screws 30*a*–30*e*. While all of the alignment holes are not exposed in the drawings, FIG. 2 illustrates alignment holes 51*a*, 51*b* and 51*e* defined in upper clamp plate 20 which extend about vertical mounting screws 30*a*, 30*b* and 30*e*. The oversized relationship of the alignment with respect to the mounting screws allows the clamp plates 19 and 20 to move in a loose vertical relationship in the upper and lower housing enclosures 34 and 35. Nuts 54c and 54d are threaded onto vertical mounting screws 30*c* and 30*d* in the upper housing enclosure 34 over upper clamp plate 20, while similar nuts such as nut 55*c* are threaded onto vertical mounting screws 30*c* and 30*d* in lower housing enclosure 35 below lower clamp plate 19. A coil compression spring 56*e* is mounted about vertical mounting screw 30*e* between guide plate 18 and upper clamp plate 20 to bias the upper clamp plate upwardly away from guide plate 18. Spacer washers are positioned about vertical mounting screws 30*c* and 30*d* on opposite sides of guide plate 18 at the rear of housing 16. For example, spacer washers 57c and 58*c* are positioned about mounting screw 30*c* on opposite sides of the centrally positioned guide plate. The coil compression spring 56*e* on the front vertical mounting screw 30*e* functions to urge the upper clamp plate 20 upwardly away from the centrally located guide plate 18 while gravity functions to urge lower clamp plate downwardly away from guide plate 18, and the retaining nuts such as nuts 54*c* and 55*c* restrict the distance that the rear portions of the clamp plates can move under the bias of spring 56*e* and gravity along the length of the vertical mounting screws so that the clamp plates open apart at an angle away from guide plate 18. The spacer washers assure that the outer portions of the clamp plates 19 and 20 are urged toward engagement with guide plate 18 or the material located between the guide plate and clamp plates, as more fully described hereinafter.

Lower and upper fluid actuated rams 59 and 60 are mounted on the external horizontal surfaces of housing 16. Each ram includes a cylinder 61 and a plunger 62, and an internal coil compression spring 64 biases the plunger of each ram to its retracted position. The outer end of the plunger 62 of each ram abuts the surface of a clamp plate 19 or 20. For example, the outer end of the plunger 62 of lower ram 59 abuts lower clamp plate 19. With this arrangement, the plungers 62 of the rams 59 and 60 will move lower and upper clamp plates 19 and 20 vertically toward the centrally located guide plate 18. The vertical mounting screws 30*a*–30*e* will function to guide the vertical movement of the clamp plates. The coil compression spring 56*e* extending about the centrally located mounting screw 30*e* tends to hold the outer portion of the upper clamp plate 20 away from the outer portion of the guide plate while gravity tends to hold the outer portion of the lower clamp plate 19 away from the outer portion of the guide plate and the retaining nuts 54*c*, 54*d*, 55*c*, 55*d* restrict the distance that the rear portions of the clamp plates can move away from the rear portion of the guide plates 18, causing the clamp plates to open at an incline. The length of the stroke of the plungers 62 of the rams 59 and 60 is greater than the length of possible movement of the rear portions of the clamp plates along the lengths of the vertical mounting screws 30*c* and 30*d*. This results in the outer ends of the clamp plates 19 and 20 and the protrusions 48 of the brackets 44 and 45 mounted on the outer ends of the clamp plates to move a further distance than the length of the strokes of the plungers 62. Moreover, when the outer edge portions of the clamp plates 19 and 20 are pushed by the rams into abutment with the lower and upper surfaces of the guide plate 18 or with the material positioned on opposite sides of the guide plate, the inner end portions of the clamp plates are also urged against the spacer washers surrounding the rear vertical mounting screws 30*c* and 30*d*, such as the washers 57*c* and 58*c*, which causes the mounting plates 19 and 20 to move toward substantially a parallel relationship with respect to each other.

Figure 3:
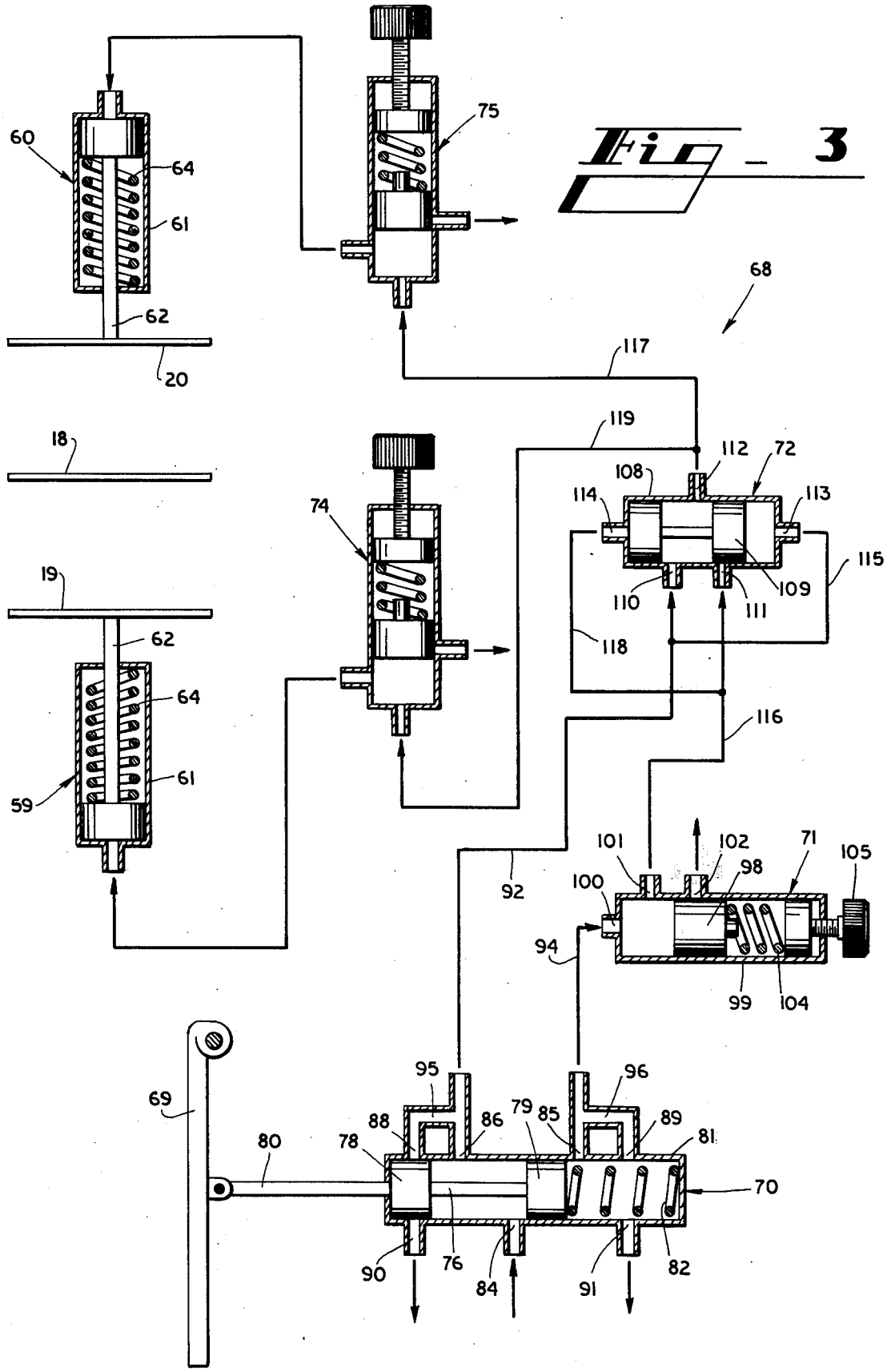
FIG. 3 is a schematic illustration of the fluid control system.

As is illustrated in FIG. 3, a fluid controlled system 68 is provided for functioning as a means to control the fluid powered ram 59 and 60. Fluid control system 68 includes an operator's pedal 69 that is located at knee level or on the floor for operation by the operator, operator's control valve 70, pressure control valve 71, shuttle valve 72, and pressure control valves 74 and 75. The operator's control valve 70 includes plunger 76 which includes two enlarged spools 78 and 79 and actuating stem 80. The plunger 76 is located in housing 81 and coil compression spring 82 urges the plunger to the far left against the operator's pedal 69. Compressed air inlet 84 communicates with a source of air under pressure (not shown) and compressed air outlets 85 and 86 are positioned on opposite sides of the housing from the inlet 84. Exhaust inlets 88 and 89 are located outside of compressed air outlets 85 and 86 and exhaust outlets 90 and 91 are positioned across the housing from inlets 88 and 89. Air conduit 92 communicates with compressed air outlet 86 and with shuttle valve 72, and air conduit 94 communicates with compressed air outlet 85 and with pressure control valve 71. Branch conduits 95 and 96 communicate with air conduits 92 and 94 and with their respective exhaust inlets 88 and 89.

When plunger 76 of the operator's control valve 70 is in the position illustrated, the compressed air from the source will flow through compressed air inlet 84 and through compressed air outlet 86 and pass through air conduit 92 to shuttle valve 72. In the meantime, pressure control valve 71 is vented through air conduit 94, ports 85 and 89 and 91 of the valve housing 81. When the operator depresses pedal 69 for one-half of the distance of the travel of valve plunger 76 through valve housing 81, both compressed air outlets 85 and 86 will be covered by the spool 78 of the plunger and both their conduits 92 and 94 will be vented through their branch air conduits 95 and 96, ports 88 and 89 and 90 and 91. When the operator depresses the pedal 69 so that the plunger 76 moves to its full in position, the left spool 78 will uncover ports 86, 88 and 90 to vent air conduit 92, while the right spool 78 will cover exhaust inlet 89 and uncover compressed air outlet 85, allowing the compressed air from the source to move through port 84, port 85, and through air conduit 94 to pressure control valve 71.

Pressure control valves 71, 74 and 75 can be of conventional construction and are schematically illustrated herein as simple spring pressure control valves. For example, pressure control valve 71 includes valve plunger 98, housing 99, air inlet port 100, air outlet port 101, and air vent port 102. Coil compression spring 104 is located behind plunger 98 and the tension of the spring can be adjusted by rotating the screw adjustment 105. When air moves into port 100 it tends to urge the plunger 98 against the bias of spring 104 to uncover port 101, which allows the air to move from port 100 to 101. If the pressure in the housing is sufficient to compress the spring further, plunger 98 will uncover vent port 102 which bleeds a portion of the air pressure to the atmosphere. Therefore, pressure control valves 71, 74 and 75 function to reduce the air pressure flowing through the valves if the air pressure flowing through the valves is excessive.

Shuttle valve 72 comprises housing 108 and double spool plunger 109. Two inlet ports 110 and 111 are defined in the housing and a single outlet port 112 is positioned intermediate the inlet port. End ports 113 and 114 are defined in the housing. Air conduit 92 communicates with inlet port 110 while its branch conduit 115 communicates with the opposite end port 113. Air conduit 116 communicates with the exhaust port 101 of pressure control valve 71 and with inlet port 111 of the shuttle valve 72, and branch conduit 118 communicates with the opposite end port 11 of the housing. With this arrangement, when a surge of air pressure is passed through air conduit 92, shuttle valve 109 will be shifted to the left under the influence of air passing through the branch conduit 115 and through port 113 to the right side of the shuttle valve, which opens communication between ports 110 and 112 and closes communication between ports 111 and 112. Thus, high pressure air flowing through the air conduit 92 will pass through the shuttle valve and through the conduits 117 and 119 that communicate with the exhaust port 112 of the shuttle valve. The air traveling through the shuttle valve and through the conduits 117 and 119 pass through the pressure control valves 76 and 75 to the rams 59 and 60 and cause the rams to distend against the bias of their springs 64 and move the clamp plates 19 and 20 toward guide plate 18.

Since the coil compression spring 82 in the operator's control vave 70 normally holds the plunger 76 in the position illustrated, the clamp plates 19 and 20 normally will be urged by their rams 59 and 60 toward engagement with guide plate 18 at maximum force as regulated by the pressure control valves 74 and 75. When the operator depresses pedal 69 to its intermediate position, the spools of plunger 76 will block both compressed air outlets 85 and 86 of the operator's control valve and the air in the system will be bled back through the system around the opposite ends of the plunger 76, causing the rams 59 and 60 to retract under the bias of their springs 64, causing the clamp plates 19 and 20 to move away from guide plates 18.

When the operator moves the pedal 69 to its fully depressed position, plunger 76 will be moved to the right in its valve housing against the bias of spring 82, which covers compressed air outlet 86 but opens compressed air outlet 85, thereby causing the air pressure from the source to communicate with pressure control valve 71. Pressure control valve 71 effectively reduces the pressure of the air as it leaves the pressure control valve and moves to the shuttle valve 72. The shuttle 109 in the shuttle valve is shuttled to the right by the pressure moving to the left end of the valve, closing communication between ports 110 and 112 and opening communication between ports 111 and 112, which causes the lower air pressure to move through the pressure control valves 74 and 75 to the rams 59 and 60. The plunger 62 of the rams 59 and 60 will thereupon be distended as before, but with a smaller amount of force. The air pressure applied to the rams will be sufficient to overcome the bias of springs 64 to move the clamp plates 19 and 20 toward abutment with guide plate 18.

Figure 4:
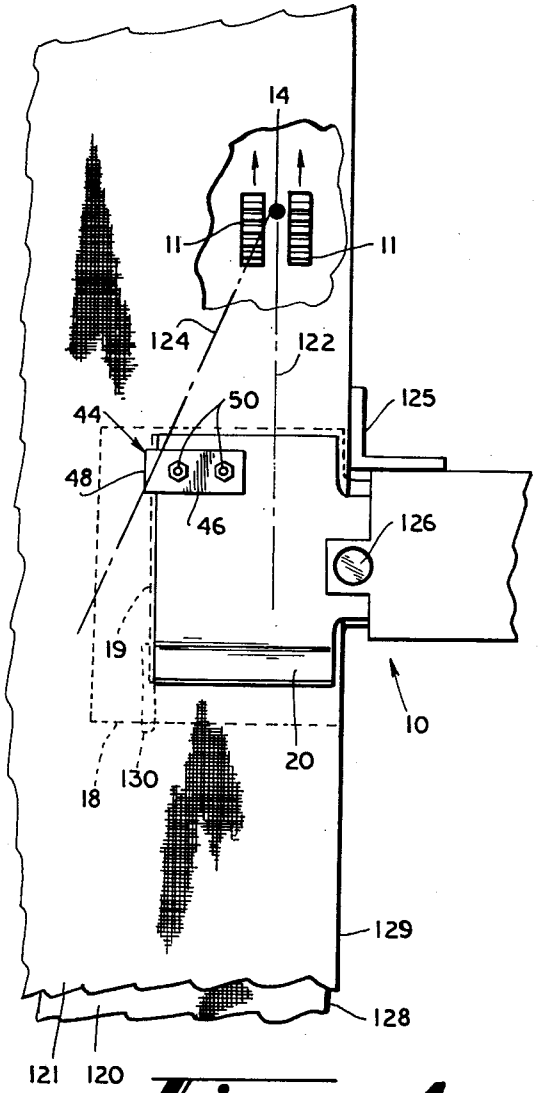
FIG. 4 is a schematic illustration of the sewing machine feeder system as it is associated with the feed dogs and needle of a sewing machine, and illustrates the effective path of pull by the feed dogs of the sewing machine and the effective line of tension applied by the guide means.

As is illustrated in FIG. 4, the feed dogs 11 oscillate during the sewing function of the sewing machine and tend to pull the plies of material 120 and 121 through the reciprocatable needle 14 along a line of pull 122 that extends rearwardly from the needle 14 back through the entrance to the sewing machine. It should be noted that the guide plate 18 and lower and upper clamp plates 19 and 20 span the path of pull 122 of the feed dogs. The protrusions 48 of the brackets 44 and 45 extend below the inner surfaces of the clamp plates 19 and 20 so that more compression is applied to the plies of material 120 and 121 at the protrusions than at the substantially flat inner surfaces of the clamp plates 19 and 20. The compression applied by the protrusions 48 and by the substantially flat inner surfaces of the clamp plates creates a drag on the plies of material 120 and 121, causing tension to be applied to the plies of material between the guide means 10 and the feed dogs 11 and presser foot 12. The effective point of drag will be located laterally from the effective line of pull 122, possibly as far laterally over as the position of the protrusions 48, as indicated by construction line 124. Thus, as the feed dogs 11 oscillate to feed the overlying aligned plies of material 120 and 121 through the sewing machine, a twisting force is applied to the plies of material which tends to feed the plies of material in a curved path, which is curved in a counterclockwise direction.

The thickness of the plies of material handled by the guide means 10 keep the clamp plates 19 and 20 from moving into abutment with the guide plate 18. The washer spacers, such as spacers 57*c* and 58*c*, mounted about the rear vertical mounting screws 30*c* and 30*d* also keep the rear portions of the clamp plates from moving in abutment with guide plate. The effective result is that the clamp plates 19 and 20 tend to move into substantially flat contact with the material moving through the guide means, so that the material is not allowed to bunch or wrinkle at any location of contact between guide plate 18 and the clamp plates 19 and 20.

Vertical guides 125 and 126 are attached to the guide means 10. Vertical guide 125 is an L-shaped bracket attached to the vertical side of housing 16 adjacent the sewing machine while vertical guide 126 extends downwardly from tab 128 through aligned openings in the upper clamp plate 20, guide plate 18 and lower clamp plate 19. As the plies of material are pulled through the guide means 10 by the feed dogs, the plies of material are maintained in a flat configuration and the aligned edges 128 and 129 engage the vertical guides 125 and 126, so that the plies of material 120 and 121 resist the turning influence of the action of the feed dogs 11 and the effective point of drag applied by the guide means.

If the aligned edges 128 and 129 of the plies of material 120 and 121 are curved so that concave or convex edges are pulled through the guide means, the absence of an edge of material engaging the guides 125 and 126 allows the system to turn the work in a counterclockwise direction, while the presence of extra material at the aligned edges tends to push the material away from the guide means and turn the material in a clockwise direction. In either situation the material will be guided properly toward the sewing machine.

When the operator is initially placing matched pattern parts in the guide means 10, the operator depresses the pedal 69 to its intermediate position, causing the clamp plates 19 and 20 to move away from guide plate 18, creating a space sufficient for the lateral insertion of the plies of material into the guide means. When the material has been properly located in the guide means, the operator releases pedal 69, which causes the rams 59 and 60 to move the clamp plates 19 and 20 into their clamping relationship with respect to the plies of material. The operator will usually adjust the pressure control valves 74 and 75 so that the lower clamp plate 19 is urged with more force in an upward direction against the lower ply of material while the upper clamp plate is urged down against the upper ply of material with less force. The difference in the amount of forces causes more drag and therefore more tension to be applied to the lower ply of material as it is moved by the feed dogs 11 to the sewing machine.

When the operator detects a multiple ply of material passing through the guide means 10, as when a pocket or seam is passing, the operator depresses pedal 69 to its full inward position, which causes the high pressure to be exhausted from the rams and the low pressure to communicate with the rams, therefore relieving a substantial amount of force from the clamp plates 19 and 20. The enlarged portion of material then can pass through the guide means without stalling the feeding of the sewing machine. Finger 130 is attached to the outer edge of lower clamp plate 19 and extends in an inclined downward direction beyond the edge 42 of the clamp plate so as to assist in bringing the larger or bulky portions of the material in an upward direction from the lap of the operator to the guide means.

While this invention has been described in detail with particular reference to preferred embodiments thereof, it will be understood that variations and modifications can be effected within the spirit and scope of the invention as described hereinbefore and as defined in the appended claims.

I claim:

1. In combination, a sewing machine including a reciprocatable needle or the like to connect together plies of material and a material feeding means for pulling plies of material along a path through the needle, and a material guide means positioned on the infeed side of the reciprocatable needle of the sewing machine comprising a stationary guide means, first clamping means for urging the lower ply of material to be pulled into and sewn by the sewing machine upwardly against said stationary guide means, second clamping means for urging the upper ply of material to be pulled into and sewn by the sewing machine downwardly against said stationary guide means, first fluid powered ram means arranged to urge said first clamping means toward said stationary guide means and against the lower ply of material and second fluid powered ram means arranged to urge said second clamping means toward said stationary guide means and against the upper ply of material, and means for supplying pressurized fluid at varying pressures to said first and second ram means to vary the forces with which said first and second clamping means are urged against said stationary guide means.

2. The combination of claim 1 and wherein said stationary guide means comprises an approximately flat stationary guide plate positioned in an approximately horizontal attitude, and wherein said first clamping means comprises a lower clamp plate movable toward and away from the lower surface of said guide plate, and wherein said second clamping means comprises an upper clamp plate movable toward and away from the upper surface of said guide plate, and means continuously biasing said clamp plates away from said guide plate.

3. In combination, a sewing machine including a reciprocatable needle or the like to connect together plies of material and a material feeding means for pulling plies for material along a path through the needle, and a material guide means positioned on the infeed side of the reciprocatable needle of the sewing machine comprising first clamping means for engaging the lower ply of material to be pulled into and sewn by the sewing machine, second clamping means for engaging the upper ply of material to be pulled into and sewn by the sewing machine, first fluid powered ram means for closing said first clamping means onto the lower ply of material, second fluid powered ram means for closing said second clamping means onto the upper ply of material, fluid control means in communication with said first and second fluid powered ram means, said fluid control means including valve means for selectively directing a flow of fluid at a first pressure from a source of fluid under pressure to said first and second fluid powered ram means or from the source of fluid under pressure at a second pressure to said first and second fluid powered ram means or for blocking communication between the source of fluid under pressure and said fluid powered ram means and venting said fluid powered ram means, and pressure adjusting means communication with said valve means and said fluid powered ram means for selectively adjusting the pressure of the fluid applied by the valve means to the fluid powered ram means.

4. In combination, a sewing machine including a sewing needle or the like and material feeding means for pulling plies of material along a path to the needle, and apparatus for guiding plies of material through the sewing machine, said apparatus comprising means for applying tension to the lengths of the plies of material extending from the feed means of the sewing machine back through the entrance of the sewing machine, said means for applying tension to the lengths of the plies of material including means for applying a first predetermined amount of tension to the lower ply of material in a first condition and a second predetermined amount of tension to the lower ply of material which is less than the first predetermined amount of tension in a second condition, and for applying a third predetermined amount of tension to the upper ply of material which is less than the first predetermined amount of tension in the first condition and a fourth predetermined amount of tension to the upper ply of material which is less than the second predetermined amount of tension in the second condition.

5. The combination of claim 4 and wherein said means for applying tension to the lengths of the plies of material comprises a stationary flat guide plate positioned in an approximately horizontal attitude, and fluid powered clamp plates positioned on the upper and lower sides of said guide plate and movable toward and away from said guide plate.

6. In combination, a sewing machine including a reciprocatable sewing needle and a material feeding means for pulling plies of material along a path extending forwardly of the needle into the needle, and guide means positioned at the entrance to the needle and material feeding means, said guide means comprising a flat guide plate oriented in an approximately horizontal plane, an upper clamp plate positioned over said guide plate and including a substantially flat surface spanning the path of pull of the material feeding means and movable toward and away from the upper surface of said guide plate, a protrusion extending down from said upper clamp plate positioned on one side of the path of pull of the material feeding means and movable with said upper clamp plate toward and away from said guide plate, a lower clamp plate positioned beneath said guide plate and including a substantially flat surface spanning the path of pull of the material feeding means and movable toward and away from the lower surface of said guide plate, a protrusion extending up from said lower clamp plate positioned on one side of the path of pull of the material feeding means and approximately vertically aligned with the protrusion of said upper clamp plate and movable with said lower clamp plate toward and away from said guide plate, fluid powered means for urging said upper clamp plate down toward substantially flat engagement with said guide plate and for urging said lower clamp upwardly toward substantially flat engagement with said guide plate, and fluid control means for varying the force that the clamp plates are urged toward said guide plate.

* * * * *